US012359858B2

(12) United States Patent
Yan et al.

(10) Patent No.: US 12,359,858 B2
(45) Date of Patent: Jul. 15, 2025

(54) ICEMAKER APPLIANCE AND METHOD FOR REDUCING TOTAL DISSOLVED SOLIDS

(71) Applicant: Haier US Appliance Solutions, Inc., Wilmington, DE (US)

(72) Inventors: Bo Yan, Shanghai (CN); Samuel Vincent DuPlessis, Louisville, KY (US); Ronald Scott Tarr, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/015,917

(22) PCT Filed: Nov. 21, 2022

(86) PCT No.: PCT/CN2022/133087

§ 371 (c)(1),
(2) Date: Jan. 12, 2023

(87) PCT Pub. No.: WO2024/108321

PCT Pub. Date: May 30, 2024

(65) Prior Publication Data

US 2024/0337426 A1 Oct. 10, 2024

(51) Int. Cl.
*F25C 1/25* (2018.01)

(52) U.S. Cl.
CPC ..... *F25C 1/25* (2018.01); *F25C 2400/12* (2013.01); *F25C 2400/14* (2013.01); *F25C 2600/04* (2013.01)

(58) Field of Classification Search
CPC .. F25C 1/147; F25C 2400/12; F25C 2400/14; F25C 2600/04; F25C 1/25
See application file for complete search history.

(56) References Cited

U.S. PATENT DOCUMENTS

| | | | |
|---|---|---|---|
| 4,644,757 | A | 2/1987 | Hida et al. |
| 9,523,526 | B2 | 12/2016 | Brunner et al. |
| 2003/0010054 | A1 | 1/2003 | Esch et al. |

(Continued)

FOREIGN PATENT DOCUMENTS

| | | | |
|---|---|---|---|
| CN | 106403431 | A | 2/2017 |
| JP | 2000111219 | A | 4/2000 |
| JP | 4121592 | B2 | 7/2008 |

(Continued)

OTHER PUBLICATIONS

International Search Report Corresponding to Application No. PCT/CN2022/133087 on Aug. 15, 2023.

*Primary Examiner* — Cassey D Bauer
(74) *Attorney, Agent, or Firm* — Dority & Manning, P.A.

(57) ABSTRACT

An icemaker appliance and method for reducing total dissolved solids is provided. The icemaker appliance includes a closed loop circuit including a conduit fluidly coupling together a water reservoir, an icemaking vessel, and an ice reservoir. A pump is configured to flow water through the conduit. A controller is configured to selectively operate the pump and the icemaking vessel. The controller is configured to allow a temperature at the icemaking vessel to be above freezing temperature of water at the conduit; and operate the pump to flow water through the closed loop circuit.

19 Claims, 5 Drawing Sheets

(56) References Cited

U.S. PATENT DOCUMENTS

| | | | | |
|---|---|---|---|---|
| 2017/0176079 | A1* | 6/2017 | Bahel | F25C 1/22 |
| 2017/0248357 | A1 | 8/2017 | Gardner et al. | |

FOREIGN PATENT DOCUMENTS

| | | | |
|---|---|---|---|
| JP | 2012202593 | A | 10/2012 |
| JP | 2022007930 | A | 1/2022 |
| KR | 20160060934 | A | 5/2016 |

* cited by examiner

ICEMAKER APPLIANCE AND METHOD FOR REDUCING TOTAL DISSOLVED SOLIDS

CROSS-REFERENCE TO RELATED APPLICATIONS

The present application is the National Stage Entry of and claims the benefit of priority under 35 U.S.C. § 371 to PCT Application Serial No. PCT/CN2022/133087 filed Nov. 21, 2022, and entitled ICEMAKER APPLIANCE AND METHOD FOR REDUCING TOTAL DISSOLVED SOLIDS which is hereby incorporated by reference in its entirety.

FIELD

The present subject matter relates generally to freezer appliances, and more particularly to icemaker appliances and methods for reducing build-up of total dissolved solids at icemaker appliances.

BACKGROUND

Freezer appliances, such as icemaking freezer appliances, use water to generate ice or nugget ice. Water will generally include minerals that build up at various components and pathways of the icemaker appliance, such as at a bottom of an icemaking cylinder. As minerals builds up at components and pathways the icemaker appliance, levels of total dissolved solids (TDS) increase. Increasing TDS levels at water can decrease the freezing point of water, which inhibits and prevents generation of ice. To remove mineral build-up, a user may need to manually access various components of the icemaker appliance and clear away the mineral build-up. Such manual removal may be difficult for a user to access all of the necessary components and pathways. Still further, manually cleaning such components and pathways may introduce a risk of a user damaging surfaces or components when clearing away mineral build-up.

Accordingly, structures and methods for removing mineral build-up and reducing TDS at icemaker appliances is desired and would be advantageous.

BRIEF DESCRIPTION

Aspects and advantages of the invention will be set forth in part in the following description, or may be obvious from the description, or may be learned through practice of the invention.

An aspect of the present disclosure is directed to an icemaker appliance and method for reducing total dissolved solids. The icemaker appliance includes a closed loop circuit including a conduit fluidly coupling together a water reservoir, an icemaking vessel, and an ice reservoir. A pump is configured to flow water through the conduit. A controller is configured to selectively operate the pump and the icemaking vessel. The controller is configured to allow a temperature at the icemaking vessel to be above freezing temperature of water at the conduit; and operate the pump to flow water through the closed loop circuit.

Another aspect of the present disclosure is directed to a method for reducing total dissolved solids at an icemaking appliance. The icemaking appliance includes a closed loop circuit including a conduit fluidly coupling together a water reservoir, an icemaking vessel, and an ice reservoir. The icemaking appliance includes a pump configured to flow water through the conduit. A heat exchanger system is configured to selectively operate to remove heat from the icemaking appliance to generate ice. The method includes discontinuing operation of the heat exchanger system to allow a temperature at the icemaking vessel to be above freezing temperature of water at the conduit, and operating the pump to flow water through the closed loop circuit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
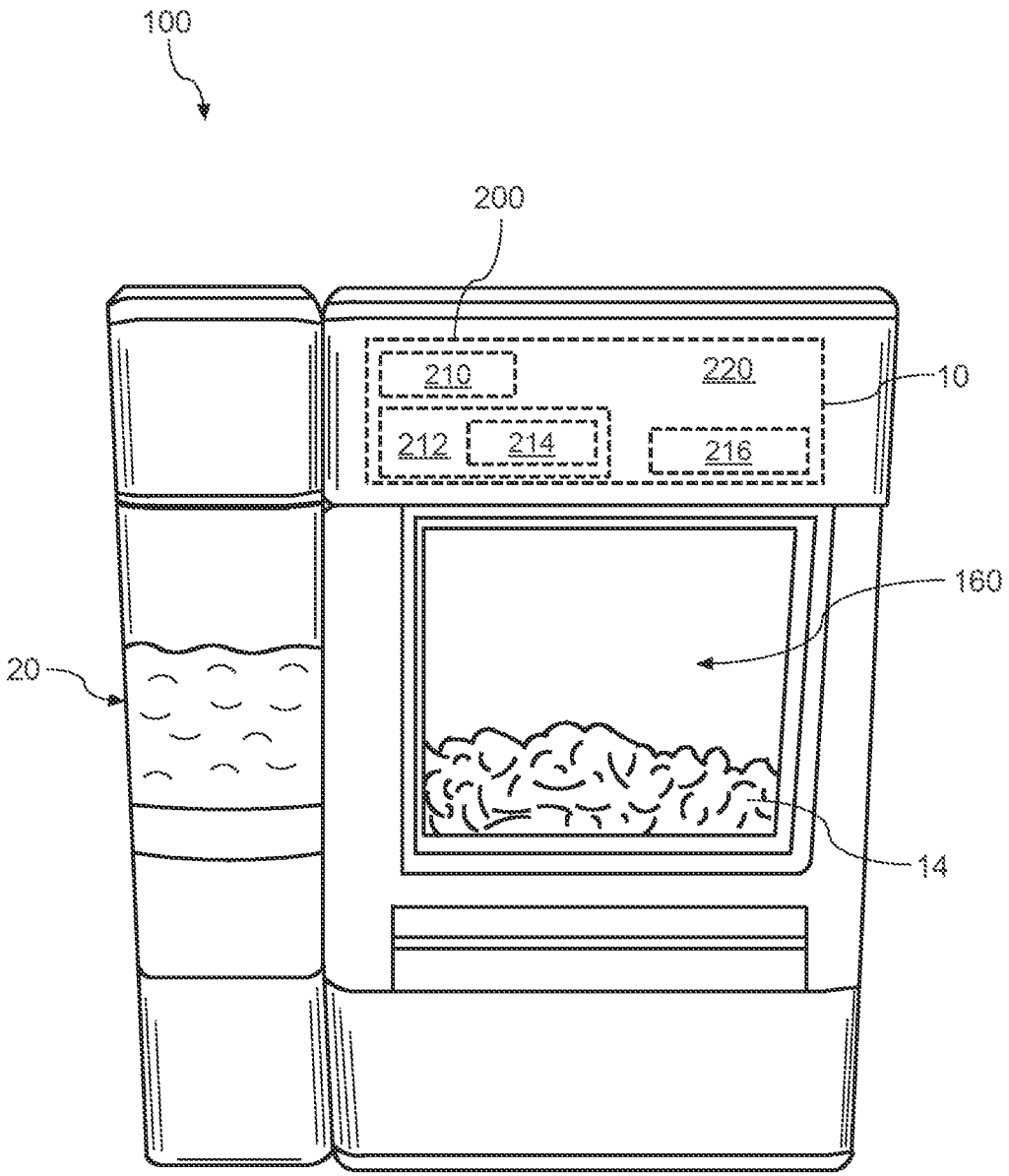
FIG. 1 provides a front view of an icemaker appliance in accordance with aspects of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Embodiments are provided herein of an icemaker appliance 100 and methods for operation 1000 for removing mineral build-up and reducing total dissolved solids (TDS) of water at icemaker appliances are provided. Structures and methods provided herein include reservoirs, conduits, and control instructions for performing a cleaning cycle that includes operating a water pump and ice maker auger, flowing water through an icemaking cylinder to mix the flowing water between a first (e.g., upper) reservoir and a second (e.g., lower) reservoir to dilute the water at the first reservoir and provide low TDS water to the second reservoir.

Referring now to the drawings, FIG. 1 provides a front view of an embodiment of an icemaker appliance 100 in accordance with aspects of the present disclosure. Icemaker appliance 100 forms an icemaking freezer appliance configured to receive a supply of water to generate ice or nugget ice. In various embodiments, appliance 100 includes an ice reservoir 160 at which ice, such as nugget ice 14, is provided and retained. In certain embodiments, a water reservoir 20 is positioned in fluid communication such as to provide water for making ice 14 and providing ice to ice reservoir 160, such as described below.

Figure 2:
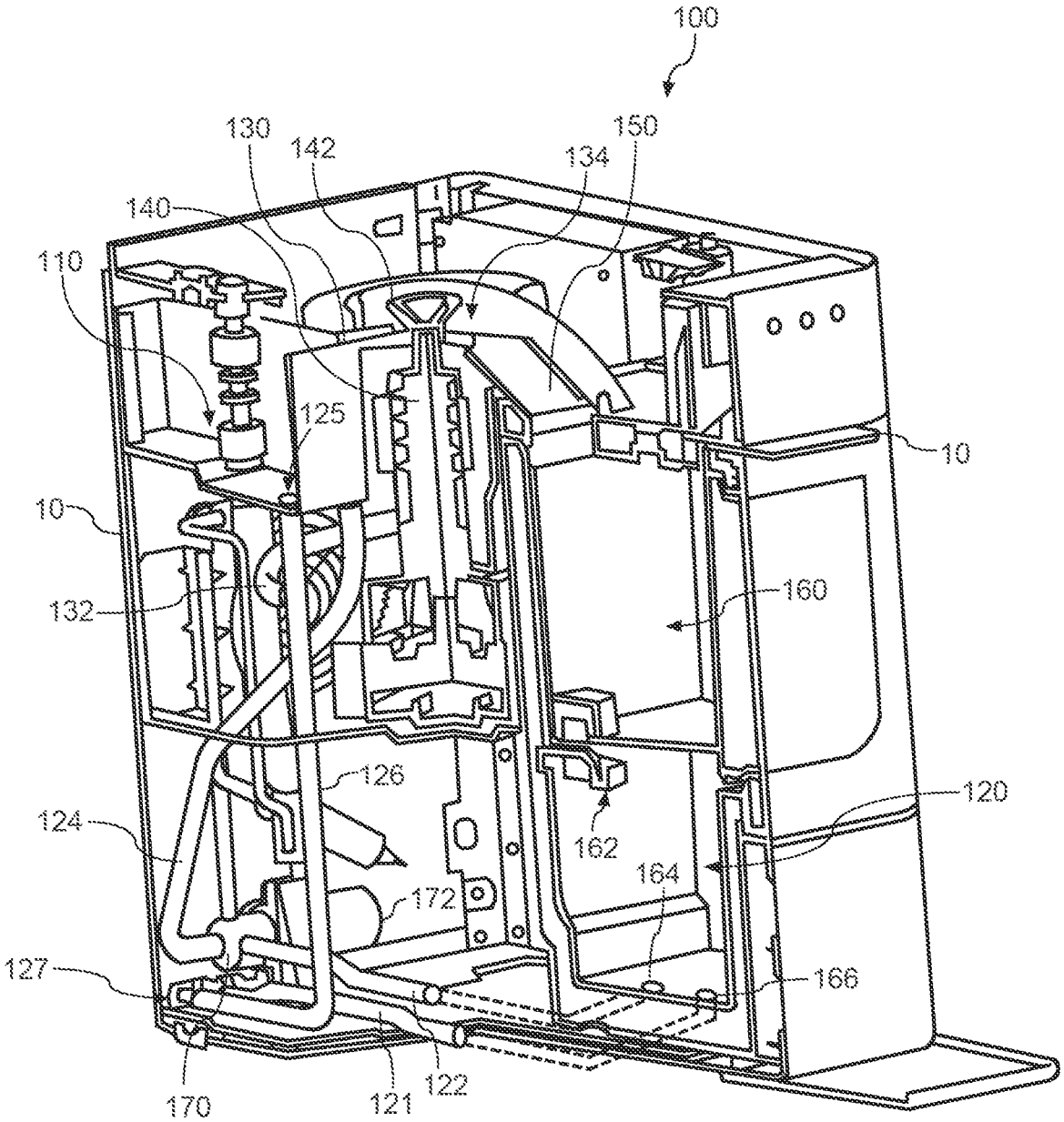
FIG. 2 provides a cutaway internal view of an embodiment of an icemaker appliance in accordance with aspects of the present disclosure.

Referring now to FIG. 2, a cutaway perspective view of an embodiment of the icemaker appliance 100 is provided. Appliance 100 includes an interior 12 formed by cabinet at which various components and conduits forming pathways are disposed. Appliance 100 includes a first reservoir 110 forming an upper reservoir relative to a second reservoir 120 forming a lower reservoir. Each reservoir 110, 120 is configured to receive quantities of water and flow the water to an icemaking cylinder 130. Appliance 100 includes a heat exchanger system, such as including a compressor (not shown) configured to flow and provide a refrigerant in thermal communication to cylinder 150, or additionally, auger 140, to remove heat from the cylinder 130 such that water provided to the cylinder 130 freezes and generates ice. Auger 140 is positioned within cylinder 130 and is operably coupled to a motor or other drive device to rotate along a central vertical axis. Rotation of auger 140 scrapes ice from the cylinder 130 and pushes the ice upward to an exit chute 150. A shaping device, such as cone 142, is positioned to break the ice egressing from the cylinder 130 and auger 140 toward the chute 150. Ice, or particularly nugget ice, egresses the cylinder 130 via chute 150 and is provided to an ice reservoir 160.

Figure 3:
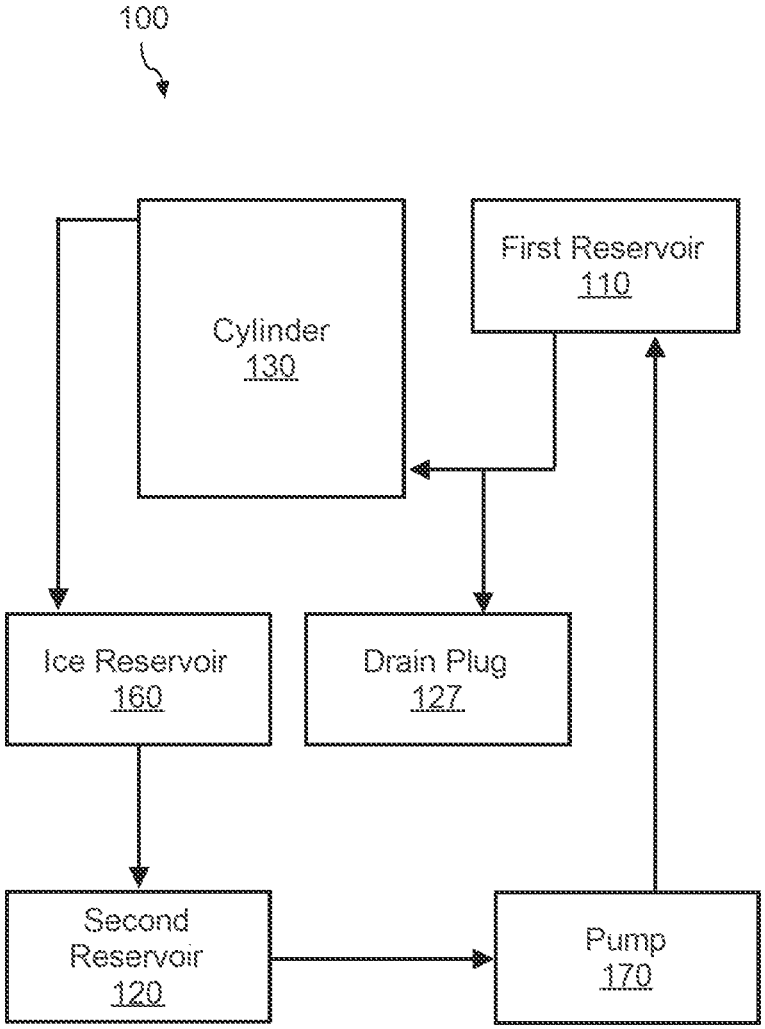
FIG. 3 provides a schematic flow diagram of an icemaker appliance in accordance with aspects of the present disclosure.
Figure 4:
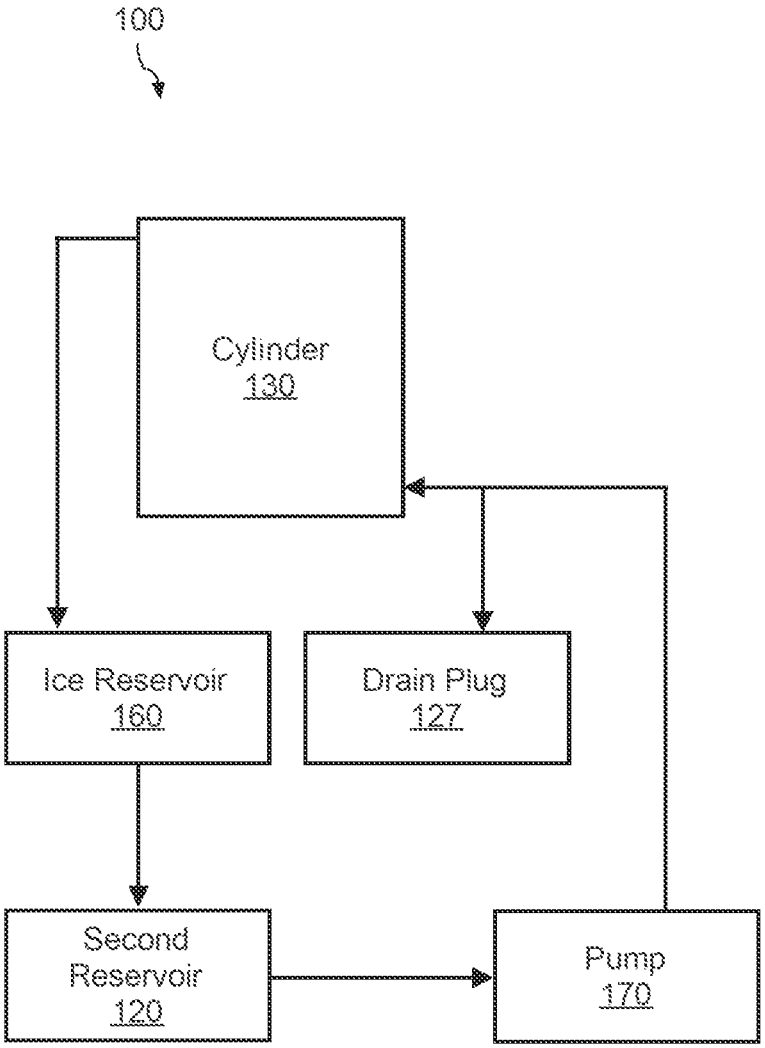
FIG. 4 provides a schematic flow diagram of an icemaker appliance in accordance with aspects of the present disclosure.

Referring now to FIGS. 2-4, in various embodiments, appliance 100 includes a plurality of conduits fluidly coupled to flow water from the second reservoir 120 to the first reservoir 110 via conduit 122. FIGS. 3-4 provide schematic depictions of flow of water through appliance 100 in accordance with embodiments of the present disclosure. Pump 170, operably coupled to motor 172, flows water from second reservoir 120 through conduit 122 to conduit 124 to first reservoir 110. Water is allowed to drain from first reservoir 110 into drain conduit 126 through opening 125 at first reservoir 110. A drain plug 127 is positioned at a downstream end of drain conduit 126 and may be desirably articulated to release and drain water from drain conduit 126 or retained at drain conduit 126.

Fluidly between drain plug 127 and opening 125 at first reservoir 110 is a supply conduit 132 extending in fluid communication from drain conduit 126 to cylinder 130. In various embodiments, supply conduit 132 is configured to provide water to a bottom end of cylinder 130. When the heat exchanger system is in operation to freeze the cylinder 130, water flowed to cylinder 130 is frozen and ice is generated, such as described above. In other methods for operation, such as further described herein, the heat exchanger system is disengaged or not operating such that cylinder 130 is above freezing temperature. Accordingly, water is allowed to flow through cylinder 130 and in fluid communication with auger 140. Water is furthermore allowed to build-up and flow through an exit 134 of cylinder 130 (e.g., a top or upper exit) and along chute 150 and into ice reservoir 160. Water received and built-up at ice reservoir 160 is allowed to flow and egress from an opening 162 from ice reservoir 160 into second reservoir 120. In certain embodiments, ice reservoir 160 is positioned above second reservoir 120, such as to allow gravity to flow water from ice reservoir 160 through opening 162 into second reservoir 120. Water may further flow from second reservoir 120 through an opening 164 to conduit 122. Accordingly, a substantially closed-loop circuit may be formed allowing water to flow from second reservoir 120 through first reservoir 110, cylinder 130, auger 140, chute 150, and ice reservoir 160.

In certain embodiments, appliance 100 includes water supply conduit 121 extending from a water source to second reservoir 120, such as via opening 166. However, it should be appreciated that in various embodiments water may be manually provided by a user (e.g., into water reservoir 20 in FIG. 1), or provided at other portions or components of the closed-loop circuit such as described herein.

Referring back to FIG. 1, operation of appliance 100 is regulated by a control device or controller 200 that is operatively coupled to user interface panel 220. Controller 200 may include one or more processors 210 and one or more memory devices 212. The one or more memory devices 212 may be configured to store instructions 214 that, when executed by the one or more processors 210, causes the appliance 100 to perform operations, such as one or more steps of methods for operation 1000 further provided herein. The memory device(s) 212 may be configured to store instructions 214, or related steps, data, schedules, etc. for operating appliance 100 in accordance with method 1000.

Panel 220 provides selections for user manipulation of the operation of appliance 100 such as e.g., selections between a cleaning mode provided by method 1000 and an icemaking operation. In response to user manipulation of the user interface panel 220, the controller 200 operates various components of the appliance 100. Controller 200 may be positioned in a variety of locations throughout appliance 100. In the illustrated embodiment shown in FIG. 1, the controller 200 is located within or behind the user interface panel 220 at cabinet 10. In such an embodiment, input/output ("I/O") signals may be routed between controller 200 and various operational components of appliance 100. In one exemplary embodiment, the user interface panel 220 may represent a general purpose I/O ("GPIO") device or functional block. In another exemplary embodiment, the user interface 220 may include input components, such as one or more of a variety of electrical, mechanical, or electro-mechanical input devices including push buttons, touch pads, touch screens, etc.

The user interface 220 may be in communication with a communications device 216 at controller 200, such as via one or more wired or wireless signal lines or shared communication busses. Communications device 216 may include any appropriate wired or wireless interface. Communications device 216 may furthermore be configured to communicate with a remote device, such as, but not limited to, a smartphone, tablet, computing device, or interconnected device, or network computing apparatus. Accordingly, one or more steps of method 1000 may be stored, transmitted, or executed from the remote device. Still further, operation signals, such as one or more signals indicative of present, past, or upcoming operation of appliance 100 in a cleaning mode, an icemaking mode, or other operating mode, may be provided to the user interface 220, the remote device, or both.

Figure 5:
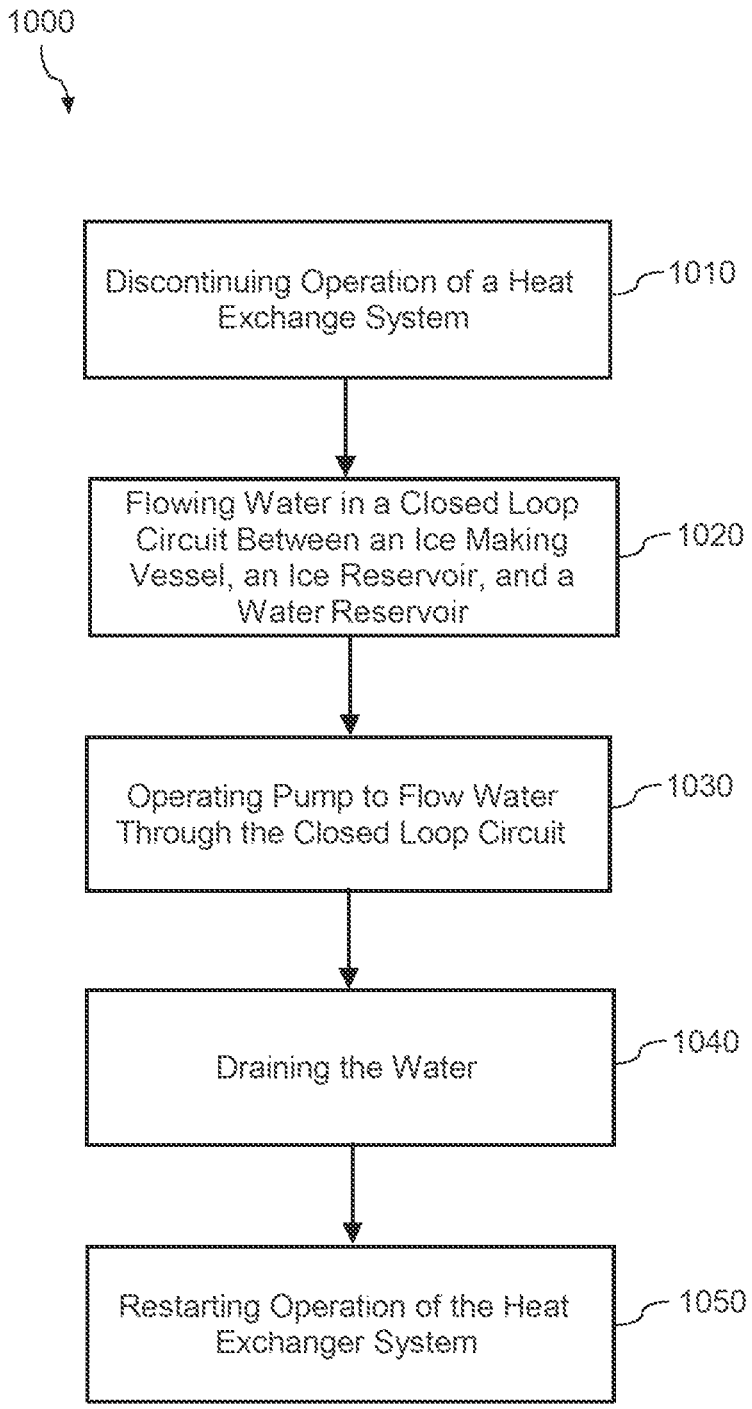
FIG. 5 provides a schematic flowchart of method for operating an icemaker appliance in accordance with aspects of the present disclosure.

Referring now to FIG. 5, a schematic flowchart outlining steps of a method for operating an ice maker appliance ("method 1000") is provided. Embodiments of method 1000 provide a cleaning mode or operation for removing minerals and reducing total dissolved solids (TDS) at an icemaking appliance. Embodiments of method 1000 may be stored as steps or instructions at a controller or network computing device and executed at an icemaker appliance, such as controller 200 and appliance 100 depicted and described herein. However, it should be appreciated that various embodiments of method 1000 may be stored, performed, and executed at various other embodiments of icemaking appliances. Particular embodiments of method 1000 may be executed at a standalone icemaking appliance, such as an icemaker appliance separate from a refrigerator appliance.

Method 1000 includes at 1010 discontinuing operation of a heat exchanger system, such as to allow a temperature at an icemaking vessel (e.g., cylinder 130) to be above freezing temperature of water.

Method 1000 includes at 1020 flowing water in a closed loop circuit between the icemaking vessel, an ice reservoir, and a water reservoir (e.g., first reservoir 110). In certain embodiments, flowing water in closed loop circuit includes building a water height at the water reservoir to approximately an equal level to a height of the icemaking vessel. In particular embodiments, flowing water in the closed loop circuit includes flowing water through the closed loop circuit for a plurality of cycles. In still particular embodiments, method 1000 includes egressing water from the icemaking vessel to the ice reservoir via an upper exit at the icemaking vessel. In certain embodiments, the upper exit is positioned at an approximately equal height to the height of the icemaking vessel. Accordingly, all, or substantially all, of a volume of the icemaking vessel is flowed with water during, or as a result of, step 1020.

In certain embodiments, the closed loop circuit includes a lower reservoir (e.g., reservoir 120) relative to an upper reservoir (e.g., reservoir 110) substantially equal in height to the icemaking vessel (e.g., cylinder 130). The closed loop circuit may further include fluid communication with an auger (e.g., auger 140) at the icemaking vessel. Still particular embodiments include the closed loop circuit at an ice egress chute (e.g., chute 150) and into an ice reservoir (e.g., ice reservoir 160) and back into lower reservoir.

Method 1000 may particularly include at 1030 operating a pump (e.g., pump 170) to flow water through the closed loop circuit. Still particular embodiments include discontinuing operation of the heat exchanger system to allow for the temperature at the icemaking vessel to rise above freezing temperature of water, then operating the pump to flow water through the closed loop circuit.

In certain embodiments, a user may manually remove ice from the ice reservoir and provide inputs at user interface 220 to command performance of method 1000. Accordingly, method 1000 may be performed for a first period of time until mineral build-up at the icemaking vessel, auger, or various reservoirs may be removed or substantially decreased. Following one or more iterations of step 1020, method 1000 may include at 1040 draining the water (e.g., via drain conduit 126 and drain plug 127). In particular embodiments, step 1040 includes draining the water through a drain plug after completing a plurality of cycles of flowing water though the closed loop circuit.

In still certain embodiments, method 1000 may be performed for a plurality of cycles of step 1020 for a second period of time until ice that may be present at ice reservoir may be melted and removed. For instance, method 1000 may be performed at a predetermined time (e.g., night-time, daytime working hours, weekly, monthly, or user-determined time, etc.) without regard for presence of ice at the ice reservoir.

In still yet various embodiments, method 1000 includes at 1050 restarting operation of the heat exchanger system. Method 1000 at 1050 allows temperature at the icemaking vessel to decrease to, or below, the freezing temperature of water, such as to allow for generation of ice. In particular embodiments, step 1010 shuts down the components or subsystems configured to remove heat and freeze the water, such as the heat exchanger system. Step 1020 is performed following restart of the appliance, such as prior to operating the heat exchanger system to remove heat and freeze water to generate ice and provide ice to the ice reservoir.

Particular embodiments of method 1000 and appliance 100 provided herein may be particular to nugget icemaking appliances. Nugget icemaking appliances may contrast with other icemaking devices (e.g., refrigerator appliances), such as by an absence of trays of water configured to retain water until ice is frozen, or moving or rotary components at nugget icemaking appliances (e.g., cylinder 130 and auger 140) configured to generate ice while moving the ice through a conduit, or the relative speed of a nugget ice maker in generating ice in contrast to refrigerator appliances. One skilled in the art will appreciate that such differences in structure and operation may patentably separate nugget icemaking appliances from other icemaking devices. Furthermore, appliances, such as appliance 100 and method 1000 provided herein, may allow for icemaking and cleaning operation not allowed by other icemaking devices.

Further aspects of the present disclosure are provided in one or more of the following clauses:

1. An icemaker appliance, including a closed loop circuit including a conduit fluidly coupling together a water reservoir, an icemaking vessel, and an ice reservoir; a pump configured to flow water through the conduit; and a controller configured to selectively operate the pump and the icemaking vessel, the controller configured to allow a temperature at the icemaking vessel to be above freezing temperature of water at the conduit; and operate the pump to flow water through the closed loop circuit.

2. The icemaker appliance of any one or more of the clauses herein, the controller configured to operate the pump to flow water through the closed loop circuit after the temperature at the icemaking vessel is above freezing temperature of water at the conduit.
3. The icemaker appliance of any one or more of the clauses herein, the controller configured to operate the pump to flow water through the closed loop circuit for a plurality of cycles through the closed loop circuit.
4. The icemaker appliance of any one or more of the clauses herein, the controller configured to operate the pump to flow water through the closed loop circuit for a plurality of cycles through the closed loop circuit until ice at the ice reservoir is removed.
5. The icemaker appliance of any one or more of the clauses herein, the controller configured to drain the water through a drain plug after completing a plurality of cycles of flowing water though the closed loop circuit.
6. The icemaker appliance of any one or more of the clauses herein, the controller configured to build a water height at the water reservoir to approximately an equal level to a height of the icemaking vessel.
7. The icemaker appliance of any one or more of the clauses herein, the controller configured to egress water from the icemaking vessel to the ice reservoir via an upper exit at the icemaking vessel, the upper exit at an approximately equal height to the height of the icemaking vessel.
8. The icemaker appliance of any one or more of the clauses herein, wherein the icemaker appliance is a nugget icemaking appliance.
9. The icemaker appliance of any one or more of the clauses herein, the controller configured to allow a temperature at the icemaking vessel to be above freezing temperature of water at the conduit, and to operate the pump to flow water through the closed loop circuit for a first period of time until mineral build-up at the icemaking vessel is decreased.
10. The icemaker appliance of any one or more of the clauses herein, the controller configured to allow a temperature at the icemaking vessel to be above freezing temperature of water at the conduit, and to operate the pump to flow water through the closed loop circuit following restart of the icemaker appliance.
11. The icemaker appliance of any one or more of the clauses herein, the controller configured to discontinue operation of a heat exchanger system to allow a temperature at the icemaking vessel to be above freezing temperature of water at the conduit.
12. The icemaker appliance of any one or more of the clauses herein, the controller configured to drain the water through a drain plug after completing a plurality of cycles of flowing water though the closed loop circuit; then restart operation of the heat exchanger system.
13. A computer-implemented method for reducing total dissolved solids at an icemaking appliance, the icemaking appliance including a closed loop circuit including a conduit fluidly coupling together a water reservoir, an icemaking vessel, and an ice reservoir, the icemaking appliance including a pump configured to flow water through the conduit, and a heat exchanger system configured to selectively operate to remove heat from the icemaking appliance to generate ice, the method including discontinuing operation of the heat exchanger system to allow a temperature at the icemaking vessel to be above freezing temperature of water at the conduit; operating the pump to flow water through the closed loop circuit.
14. The method of any one or more of the clauses herein 13, the method including draining the water after completing a plurality of cycles of flowing water though the closed loop circuit; then restarting operation of the heat exchanger system to remove heat from the icemaking appliance to generate ice.
15. The method of any one or more of the clauses herein, wherein operating the pump to flow water through the closed loop circuit is after the temperature at the icemaking vessel is above freezing temperature of water at the conduit.
16. The method of any one or more of the clauses herein, the method including waiting, for a predetermined period of time, after discontinuing operation of the heat exchanger system, wherein the predetermined period of time corresponds to a period of time for water at the icemaking vessel to be above freezing temperature of water, then operating the pump to flow water through the closed loop circuit.
17. The method of any one or more of the clauses herein, wherein operating the pump includes operating the pump to flow water through the closed loop circuit for a plurality of cycles through the closed loop circuit.
18. The method of any one or more of the clauses herein, wherein operating the pump includes operating the pump to flow water through the closed loop circuit for a plurality of cycles through the closed loop circuit until ice at the ice reservoir is removed.
19. The method of any one or more of the clauses herein, wherein operating the pump includes building a water height at the water reservoir to approximately an equal level to a height of the icemaking vessel.
20. The method of any one or more of the clauses herein, wherein operating the pump includes egressing water from the icemaking vessel to the ice reservoir via an upper exit at the icemaking vessel, the upper exit at an approximately equal height to the height of the icemaking vessel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An icemaker appliance, comprising:

a closed loop circuit comprising a conduit fluidly coupling together a water reservoir, an icemaking vessel, and an ice reservoir;

a pump configured to flow water through the conduit; and a controller configured to selectively operate the pump and the icemaking vessel, the controller configured to: allow a temperature at the icemaking vessel to be above freezing temperature of water at the conduit; and operate the pump to flow water through the closed loop circuit for a plurality of cycles through the closed loop circuit.

2. The icemaker appliance of claim 1, the controller configured to operate the pump to flow water through the closed loop circuit after the temperature at the icemaking vessel is above freezing temperature of water at the conduit.

3. The icemaker appliance of claim 1, the controller configured to:

operate the pump to flow water through the closed loop circuit for a plurality of cycles through the closed loop circuit until ice at the ice reservoir is removed.

4. The icemaker appliance of claim 1, the controller configured to:

drain the water through a drain plug after completing a plurality of cycles of flowing water though the closed loop circuit.

5. The icemaker appliance of claim 1, the controller configured to:

build a water height at the water reservoir to approximately an equal level to a height of the icemaking vessel.

6. The icemaker appliance of claim 5, the controller configured to:

egress water from the icemaking vessel to the ice reservoir via an upper exit at the icemaking vessel, the upper exit at an approximately equal height to the height of the icemaking vessel.

7. The icemaker appliance of claim 1, wherein the icemaker appliance is a nugget icemaking appliance.

8. The icemaker appliance of claim 1, the controller configured to:

allow a temperature at the icemaking vessel to be above freezing temperature of water at the conduit, and to operate the pump to flow water through the closed loop circuit for a first period of time until mineral build-up at the icemaking vessel is decreased.

9. The icemaker appliance of claim 1, the controller configured to:

allow a temperature at the icemaking vessel to be above freezing temperature of water at the conduit, and to operate the pump to flow water through the closed loop circuit following restart of the icemaker appliance.

10. The icemaker appliance of claim 1, the controller configured to:

discontinue operation of a heat exchanger system to allow a temperature at the icemaking vessel to be above freezing temperature of water at the conduit.

11. The icemaker appliance of claim 10, the controller configured to:

drain the water through a drain plug after completing a plurality of cycles of flowing water though the closed loop circuit; then restart operation of the heat exchanger system.

12. A computer-implemented method for reducing total dissolved solids at an icemaking appliance, the icemaking appliance including a closed loop circuit including a conduit fluidly coupling together a water reservoir, an icemaking vessel, and an ice reservoir, the icemaking appliance including a pump configured to flow water through the conduit, and a heat exchanger system configured to selectively operate to remove heat from the icemaking appliance to generate ice, the method comprising:

discontinuing operation of the heat exchanger system to allow a temperature at the icemaking vessel to be above freezing temperature of water at the conduit; and operating the pump to flow water through the closed loop circuit.

13. The method of claim 12, the method comprising:

draining the water after completing a plurality of cycles of flowing water though the closed loop circuit; then restarting operation of the heat exchanger system to remove heat from the icemaking appliance to generate ice.

14. The method of claim 12, wherein operating the pump to flow water through the closed loop circuit is after the temperature at the icemaking vessel is above freezing temperature of water at the conduit.

15. The method of claim 14, the method comprising:

waiting, for a predetermined period of time, after discontinuing operation of the heat exchanger system, wherein the predetermined period of time corresponds to a period of time for water at the icemaking vessel to be above freezing temperature of water; then operating the pump to flow water through the closed loop circuit.

16. The method of claim 12, wherein operating the pump comprises operating the pump to flow water through the closed loop circuit for a plurality of cycles through the closed loop circuit.

17. The method of claim 16, wherein operating the pump comprises operating the pump to flow water through the closed loop circuit for a plurality of cycles through the closed loop circuit until ice at the ice reservoir is removed.

18. The method of claim 12, wherein operating the pump comprises building a water height at the water reservoir to approximately an equal level to a height of the icemaking vessel.

19. The method of claim 18, wherein operating the pump comprises egressing water from the icemaking vessel to the ice reservoir via an upper exit at the icemaking vessel, the upper exit at an approximately equal height to the height of the icemaking vessel.

* * * * *